US006217380B1

(12) United States Patent
Nelson et al.

(10) Patent No.: US 6,217,380 B1
(45) Date of Patent: Apr. 17, 2001

(54) CONNECTOR FOR DIFFERENT SIZED COAXIAL CABLES AND RELATED METHODS

(75) Inventors: Larry W. Nelson; Ronald A. Vaccaro, both of Hickory, NC (US)

(73) Assignee: CommScope Inc. of North Carolina, Hickory, NC (US)

( * ) Notice: Subject to any disclaimer, the term of this patent is extended or adjusted under 35 U.S.C. 154(b) by 0 days.

(21) Appl. No.: 09/328,067

(22) Filed: Jun. 8, 1999

(51) Int. Cl.[7] ..... H01R 9/05
(52) U.S. Cl. ..... 439/578
(58) Field of Search ..... 439/578, 675, 439/322, 583, 584

(56) References Cited

U.S. PATENT DOCUMENTS

| | | | |
|---|---|---|---|
| 3,245,027 | 4/1966 | Ziegler, Jr. | 439/585 |
| 3,390,375 | 6/1968 | Salmonson | 439/894 |
| 3,439,294 | 4/1969 | Flanagan et al. | 333/33 |
| 3,530,423 | 9/1970 | Davis | 29/857 |
| 3,534,322 | 10/1970 | Hoffa | 439/274 |
| 3,550,146 | 12/1970 | Eberle | 343/879 |
| 3,624,679 | 11/1971 | Ziegler, Jr. | 29/828 |
| 3,678,447 | 7/1972 | Ziegler, Jr. et al. | 439/585 |
| 3,874,960 | 4/1975 | Matsuzaki et al. | 156/49 |
| 4,184,165 | 1/1980 | Vye | 343/874 |
| 4,493,946 | 1/1985 | Duret | 174/88 C |
| 4,853,656 | 8/1989 | Guillou et al. | 333/34 |
| 5,018,987 | 5/1991 | Kirma | 439/445 |
| 5,217,392 | 6/1993 | Hosler, Sr. | 439/585 |
| 5,371,322 | 12/1994 | Selmeski | 174/84 R |
| 5,529,522 | 6/1996 | Huang | 439/460 |
| 5,746,623 | 5/1998 | Fuchs et al. | 439/578 |
| 5,861,858 | 1/1999 | Niekamp | 343/800 |

*Primary Examiner*—Brian Sircus
*Assistant Examiner*—Son V. Nguyen
(74) *Attorney, Agent, or Firm*—Allen, Dyer, Doppelt, Milbrath & Gilchrist, P.A.

(57) ABSTRACT

A connector is for joining together a first coaxial cable having a first diameter and a second coaxial cable having a second diameter smaller than the first diameter. The connector includes a hollow connector body for joining first and second back-nut assemblies together. The first back-nut assembly preferably comprises a threaded distal end, and outer conductor clamping portions for coupling to the outer conductor of the first coaxial cable. The second back-nut assembly is similarly connected to the second coaxial cable. The hollow connector body preferably includes opposing first and second threaded ends to be threadingly engaged in the respective distal threaded ends of the first and second back-nut assemblies, and an intermediate portion having a frusto-conical shape with a larger diameter portion adjacent the first end and a smaller diameter portion adjacent the second end. A center contact is preferably positioned within an opening of a dielectric spacer carried by the hollow connector body.

38 Claims, 4 Drawing Sheets

CONNECTOR FOR DIFFERENT SIZED COAXIAL CABLES AND RELATED METHODS

FIELD OF THE INVENTION

The present invention relates to the field of cables and connectors, and, more particularly, to a connector and associated method for joining together different sized coaxial cables, as may be particularly advantageous in a wireless base station.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter cable extending between the equipment shelter and the top of the antenna tower to thereby reduce signal losses. For example, CommScope, Inc. of Hickory, N.C. and the assignee of the present invention offers its CellReach® coaxial cable for such applications. The cable includes a smooth wall outer conductor which provides superior performance to other cable types. The smooth outer wall construction also provides additional ease of attaching connector portions to the cable ends in comparison to other coaxial cable types, such as including corrugated outer conductors, for example.

Each end of the large diameter coaxial cable is connected to a respective smaller diameter, and relatively short, jumper cable. The jumper coaxial cable has a smaller diameter with greater flexibility to thereby facilitate routing at the equipment shelter and also at the top of the antenna tower. More particularly, a relatively large diameter (about 1 and ⅝ inch) main coaxial cable extends from the shelter to the top of the tower, typically about 90 to 300 feet, to reduce attenuation. The main cable may be a CellReach® model 1873 cable, for example. A short smaller diameter (about ½ inch) coaxial jumper cable is connected to each end of the main cable, and may be a CellReach® model 540 cable, for example. The top jumper is typically 3 to 6 feet long, and the bottom jumper is typically 6 to 10 feet long.

At present, and as understood with reference to the prior art arrangement shown in FIGS. 2 and 3, first and second connectors 33, 34 are typically assembled in a back-to-back relation to couple an end of the main coaxial cable 31 to an end of a jumper coaxial cable 32. The first connector 33 includes a first back-nut assembly 35 and a first body portion 36 which are threadingly engaged together. A rear 0-ring, not shown, may seal the cable sheath 54 to the first back-nut assembly 35. Similarly, the second connector 34 includes a second back-nut assembly 41 which threadingly engages a second connector body portion 42. As shown in the illustrated prior art connector arrangement 30, the first or main cable 31 includes an elongate central strength member 43, a surrounding dielectric layer 45, and a surrounding adhesive layer 46 for attachment to the tubular copper center conductor 47. A tubular dielectric layer 48 surrounds the center conductor 47. In the illustrated embodiment, a portion of the dielectric layer 48 has been removed by a coring tool to thereby facilitate assembly. A tubular plastic body 51 is inserted into the cored cable end.

A portion of the outer smooth wall conductor 53 is exposed beyond the end of the cable sheath 54. A metal clamping ring 56 is urged against the exposed outer conductor 53 as the back-nut outer cylinder 55 is threaded onto the connector body portion 36. The connector body portion 36 includes a hollow metal member 57 in which is positioned an annular dielectric spacer 61, which, in turn, supports a center contact 62. The center contact 62 includes a tubular proximal end which receives and establishes contact with the inner conductor 47. An annular dielectric body 63 provides a radially compressive force to the tubular end 63 of the center contact 62 as the back-nut 35 and connector body portion 36 are threadingly engaged. A rubber 0-ring 67 seals the interface between the first back-nut assembly 35 and the connector body portion 36. A distal end 65 of the center contact 62 is centered within a hollow tubular distal end 66 of the hollow metal member 57. The distal end 66 includes threads on its outer surface to mate with the second connector body portion 42. Another 0-ring 94 is positioned at the distal end 66 for sealing the interface with the hollow metal member 85.

Turning now to the right-hand portion of FIG. 3, the second connector 34 is briefly described. The second connector 34 includes a second back-nut assembly 41 which is connected to the end of the second or jumper cable 32. The second cable 32 includes a central metallic conductor 71, surrounded by a dielectric layer 73, a portion of which is removed to prepare the cable end. A plastic insert 74 is positioned within the cable end to support the outer conductor 75. A cylindrical member 77 is secured on the cable end and clamps to an exposed portion of the outer conductor 75 which extends outwardly beyond the end of the cable sheath 76. Additional metal rings 81, 82 and 83 cooperate with the second connector body portion 42 and cylinder 77 to provide the necessary clamping action on the outer conductor 75 and also on the inner conductor 71. A rear 0-ring, not shown, may seal the cable sheath 76 to the second back-nut assembly 41.

The second connector body portion 42 includes a hollow metal member 85 which mounts an annular dielectric spacer 86 and which, in turn, carries a center contact 87. The center contact 87 includes a tubular distal end 88 which receives and is clamped against the inner conductor 71 by the annular dielectric body 90. An 0-ring 91 seals the interface between the second connector body portion 42 and the second back-nut assembly 41. A collar 92 including internal threads on its distal end is rotatably connected at its proximal end to a recess in the distal end of the hollow metal member 85. The collar 92 secures the first connector 33 to the second connector 34. The distal end 93 of the center contact 87 engages the distal end 65 of the center contact 62 in the region of the collar 92.

As will readily be appreciated, the back-to-back connector arrangement 30 includes a relatively large number of component parts which is relatively expensive and may be difficult to assemble. Such an arrangement 30 will also typically have more loss per unit length than the coaxial cable. Such a back-to-back connector arrangement 30 can be unreliable, and presents multiple interfaces for water leakage into the cable. The connector arrangement 30 also presents a number of abrupt edge surfaces which may make routing through restricted openings difficult, such as at the tower entry and exit ports, or at collars at spaced heights within a monopole tower.

A number of patents disclose other arrangements of connectors for securing a larger diameter coaxial cable to a smaller diameter coaxial cable. For example, U.S. Pat. No. 4,853,656 to Guilou et al. discloses such a device. The device comprises a central core in the shape of a truncated cone, whose circular bases have sections respectively identical to those of the central cores of the coaxal cables to be connected together, as well as a peripheral sheath, whose internal wall is a truncated cone shaped surface, whose circular bases have sections respectively identical to the internal sections of the peripheral sheaths of the coaxial cables. The small bases of the truncated cones of the central core and the peripheral sheath are two parallels of a first sphere centered on the apex of the truncated cone surface of the internal wall. The large bases of the truncated cones of the central core and of the peripheral sheath are two parallels of a second sphere concentric with the first one. This arrangement is disclosed for enhancing the propagation of electromagnetic waves through the device. Unfortunately, this device is also relatively complicated and difficult to assemble. In addition, a number of threaded interfaces are present which may permit water to enter the device and thereby reduce its reliability.

SUMMARY OF THE INVENTION

In view of the foregoing background, it is therefore an object of the present invention to provide a reliable and easy to assembly connector and associated method for joining together two coaxial cables having different diameters, as may commonly be used in a wireless base station, for example.

This and other objects, features and advantages in accordance with the present invention are provided by a coaxial cable connector for joining together a first coaxial cable having a first diameter and a second coaxial cable having a second diameter smaller than the first diameter, and comprising a hollow connector body for joining first and second back-nut assemblies together. Each coaxial cable has an inner conductor, a dielectric region surrounding the inner conductor, and an outer conductor surrounding the dielectric region. The first back-nut assembly preferably comprises a threaded distal end, and outer conductor clamping portions for coupling to the outer conductor of the first coaxial cable. Similarly, the second back-nut assembly preferably comprises a threaded distal end, and outer conductor clamping portions for coupling to the outer conductor of the second coaxial cable.

The hollow connector body preferably includes opposing first and second threaded ends to be threadingly engaged in the respective distal threaded ends of the first and second back-nut assemblies, AND an intermediate portion having a frusto-conical shape with a larger diameter portion adjacent the first end and a smaller diameter portion adjacent the second end. In addition, the connector also preferably includes a dielectric spacer positioned within a medial portion of the hollow connector body. A center contact is preferably positioned within an opening of the dielectric spacer. The center contact may have opposing ends for coupling to the respective inner conductors of the first and second coaxial cables.

The first and second threaded ends, and the intermediate portion of the hollow connector body are preferably integrally formed so that the hollow connector body is a monolithic unit. Accordingly, the connector is relatively straightforward to assemble and is reliable in service. First and second sealing rings may be provided for forming respective first and second seals between the first and second back-nut assemblies and the hollow connector body. Accordingly, resistance to moisture penetration is further enhanced. Each of the distal threaded ends of the first and second back-nut assemblies may be internally threaded, and, thus, each of the first and second threaded ends of the hollow connector body maybe externally threaded.

The hollow connector body may comprise portions defining an internal cylindrical passageway with a shoulder adjacent the smaller diameter end. In this embodiment, the dielectric spacer is positioned in the internal cylindrical passageway and abuts the shoulder.

The first and second ends of the center contact may have a tubular shape for receiving therein the first and second inner conductors respectively. The first and second ends of the center contact may also have elongate slots therein. The connector may also include first and second dielectric clamping members for clamping the first and second tubular ends of the center contact onto the respective inner conductors of the first and second coaxial cables responsive to progressive tightening of the threaded engagement between the first and second threaded ends of the hollow connector body and the respective threaded distal ends of the first and second back-nut assemblies.

The hollow connector body may include a generally cylindrical intermediate portion with a series of gripping portions on a periphery thereof. These gripping portions may be flats or spanner holes to facilitate gripping during assembly. The hollow connector body may comprise brass with a silver plating thereon.

Another advantageous feature of the present invention is that the outer conductor of the first coaxial cable may be a smooth wall conductor, and the outer conductor clamping portions of the first back-nut assembly are configured to engage the smooth wall conductor of the first coaxial cable. Of course, both cables may have a smooth wall outer conductor. In addition, one or both of the coaxial cables may have a corrugated outer conductor.

A method aspect of the invention is for joining together a first coaxial cable having a first diameter and a second coaxial cable having a second diameter smaller than the first diameter. Each coaxial cable has an inner conductor, a dielectric region surrounding the inner conductor and an outer conductor surrounding the dielectric region. The method preferably comprises the steps of: attaching a first back-nut assembly on the first coaxial cable, the first back-nut assembly comprising a threaded distal end, and outer conductor clamping portions coupling to the outer conductor of the first coaxial cable; and attaching a second back-nut assembly on the second coaxial cable. The second back-nut assembly may comprise a threaded distal end, and outer conductor clamping portions coupling to the outer conductor of the second coaxial cable.

More particularly, the method also preferably includes the step of attaching the first and second back-nut assemblies together using a hollow connector body comprising opposing first and second threaded ends to be threadingly engaged in the respective distal threaded ends of the first and second back-nut assemblies, and an intermediate portion having a frusto-conical shape with a larger diameter portion adjacent the first end and a smaller diameter portion adjacent the second end. A dielectric spacer is preferably positioned within a medial portion of the hollow conductive body and has an opening extending therethrough. An elongate center contact is preferably positioned within the opening of the dielectric spacer and has opposing ends for coupling to the respective inner conductors of the first and second coaxial cables. The first and second ends and the intermediate portion of the hollow connector body are preferably integrally formed so that the hollow connector body is a monolithic unit.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
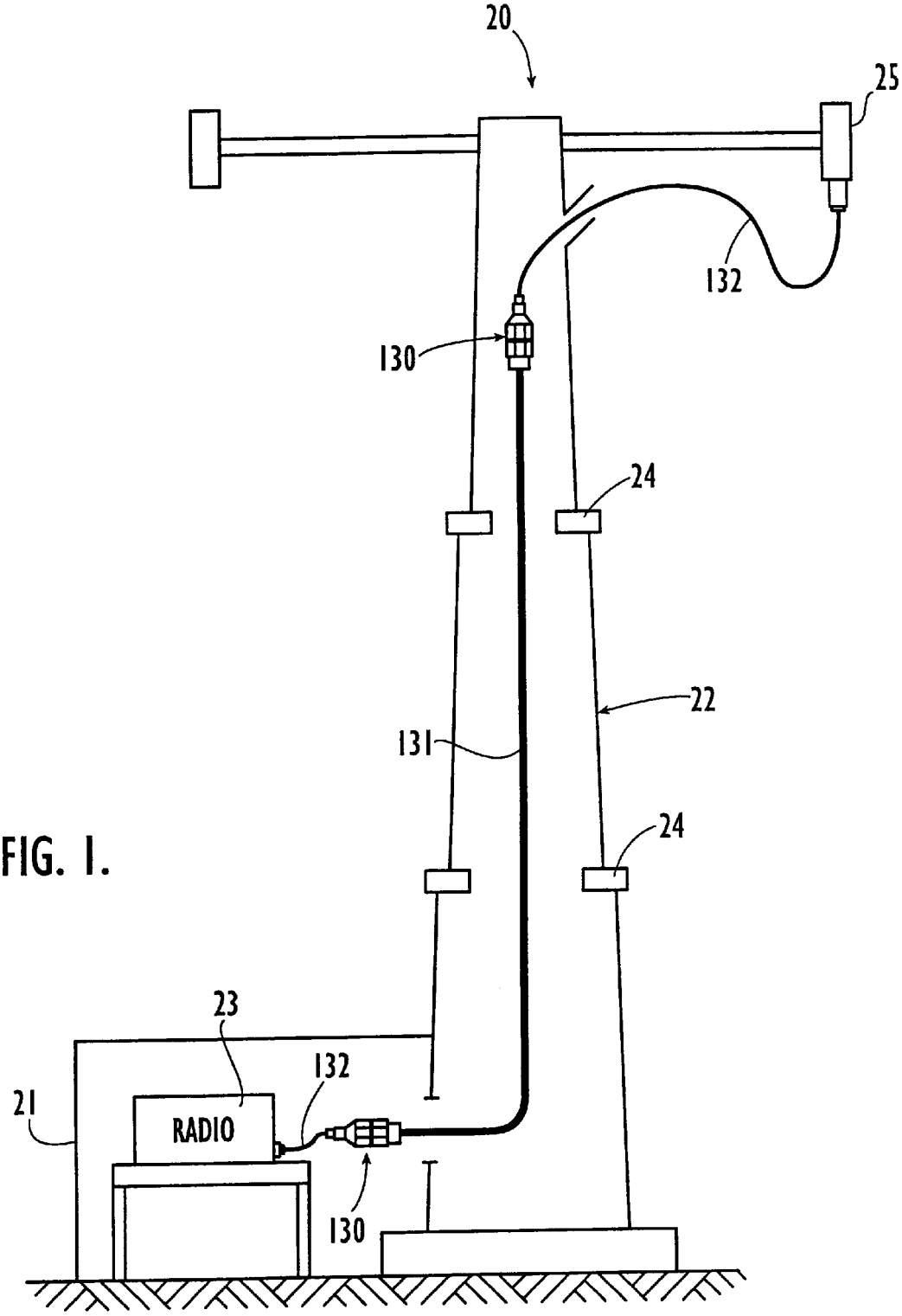
FIG. 1 is a schematic view of a wireless base station including a pair of connectors joining upper and lower jumper coaxial cables to a larger diameter main coaxial cable in accordance with the present invention.

Referring initially to FIG. 1, one particularly advantageous application of the connector 130 of the invention in a cellular or wireless base station system 20 is described. Two connectors 130 are illustrated to connect the main coaxial cable 131 to the upper and lower jumper or smaller diameter coaxial cables 132. As noted above in the Background of the Invention section, the main coaxial cable 131 may be a suitable length of CellReach® model 1873 cable, for example. The smaller diameter jumper coaxial cables 132 may be suitable lengths of CellReach® model 540 cable, for example. Both cables may have a smooth wall outer construction and are available from the assignee of the present invention, CommScope, Inc. of Hickory, N.C. The top jumper may typically be about 3 to 6 feet long, and the bottom jumper may typically be about 6 to 10 feet long.

As will be readily appreciated by those skilled in the art, other coaxial cable types and sizes may be used with the connector 130 of the present invention. Typical cable pairings using the CellReach® designations may be: jumper 540, main 1873; jumper 1070, main 1873; jumper 540, main 1070; and jumper 396, main 1070. In other words, the jumper cable may be about ¼ inch to 1 and ¼ inches in diameter, and the main cable may be from about 1 to 3 inches in diameter.

The lower jumper coaxial cable 132 is connected to the schematically illustrated radio 23. In addition, at the upper end of the antenna tower 22, the upper jumper cable 132 is connected to the antenna 25. Each transmitter and receiver of a radio 23 is connected to such a coaxial cable system including the main cable 131, jumper cables 132, and connectors 130 as will be readily appreciated by those skilled in the art. Of course, a typical system 20 may include a plurality of radios 23, and antennas 25. Although the illustrated example of the cellular or wireless base station system 20 greatly benefits from the connector 130 in accordance with the invention, the connector can be used in many other applications as well.

In the illustrated embodiment, the radio 23 is positioned within an equipment shelter 21 as is typically located in proximity to the base of the antenna tower or monopole 22 as would be appreciated by those skilled in the art. The radio 23 may also be mounted in its own relatively compact environmental housing. As schematically illustrated, the interior of the antenna tower 22 may present one or more restricted openings such as defined by the vertically spaced apart collars 24. A conventional back-to-back connector arrangement 30 (FIGS. 2 and 3) may be difficult to route past such obstructions because of the abrupt edge surfaces presented by such a connector arrangement.

Referring now additionally to FIGS. 4 through 8, the coaxial cable connector 130 of the invention is now described in greater detail. To simplify the description and highlight the invention, the first and second cables 131, 132 and their respective components are indicated with reference numerals incremented by 100 to correspond with the elements already described for the prior art connector arrangement 30 of FIGS. 2 and 3. Accordingly, these cable components need no further discussion herein. Similarly, the first and second back-nut assemblies 135, 141 are similar to those assemblies 35, 41 for the prior art connector arrangement 30 described above with reference to FIGS. 2 and 3. The components of the first and second back-nut assemblies 135, 141 are similar and are designated by reference numerals incremented by 100 over those corresponding components in FIGS. 2 and 3. The first and second back-nut assemblies 135, 141 are not further described in detail, so that the ensuing discussion can focus more particularly on the connector portion 200 of the connector 130.

In particular, the connector portion 200 includes a hollow connector body 201 for joining together first and second back-nut assemblies 135, 141. The first back-nut assembly 135 includes a distal end defining an internally threaded first nut, and outer conductor clamping portions 156, 151 for coupling to the outer conductor 153 of the end of the first coaxial cable 131. Similarly, the second back-nut assembly 141 comprises a distal end portion defining an internally threaded second nut and outer conductor clamping portions 177, 181 and 174 for coupling to the outer conductor 175 of the end of second coaxial cable 132.

The hollow connector body 201 includes opposing first and second ends 203, 204 each having external threads to be threadingly engaged in the Crespective first and second nuts. The connector body 201 also illustratively includes a first cylindrical intermediate portion 205 adjacent the first end 203, and a second intermediate portion 206 having a frustoconical shape with a larger diameter portion adjacent the first intermediate portion and a smaller diameter portion adjacent the second end 204.

The connector portion 200 also includes an annular dielectric spacer 211 positioned within a medial portion of the hollow connector body 201. An elongate center contact 212 is preferably positioned within the opening of the dielectric spacer 211. The center contact 212 has opposing first and second ends 213, 214 for coupling to the respective inner conductors 147, 171 of the first and second coaxial cables 131, 132.

Figure 2:
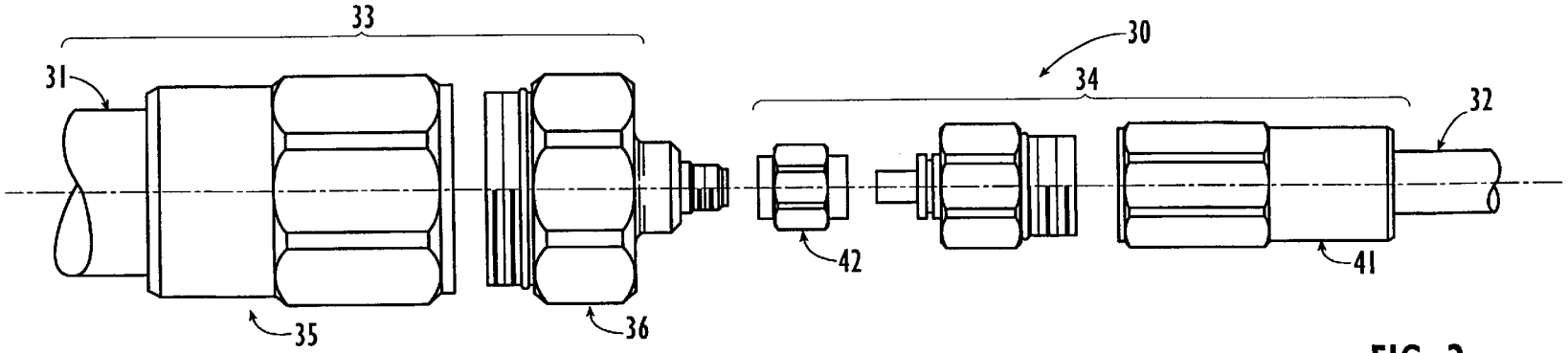
FIG. 2. (PRIOR ART)
FIG. 2 is an exploded side elevational view of a back-to-back connector arrangement, partially assembled, and as used for joining together a smaller diameter jumper coaxial cable to a larger diameter main coaxial cable as in the prior art.
Figure 3:
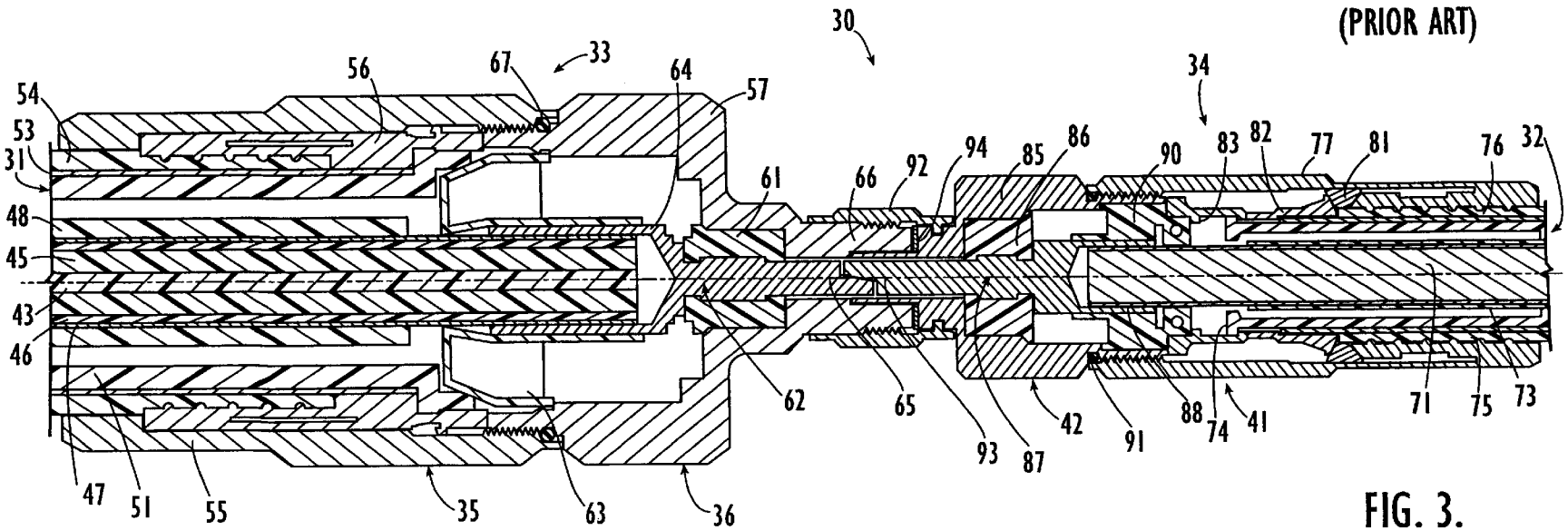
FIG. 3. (PRIOR ART)
FIG. 3 is a cross-sectional view of the back-to-back connector arrangement of the prior art as shown in FIG. 2, with the components fully assembled.
Figure 4:
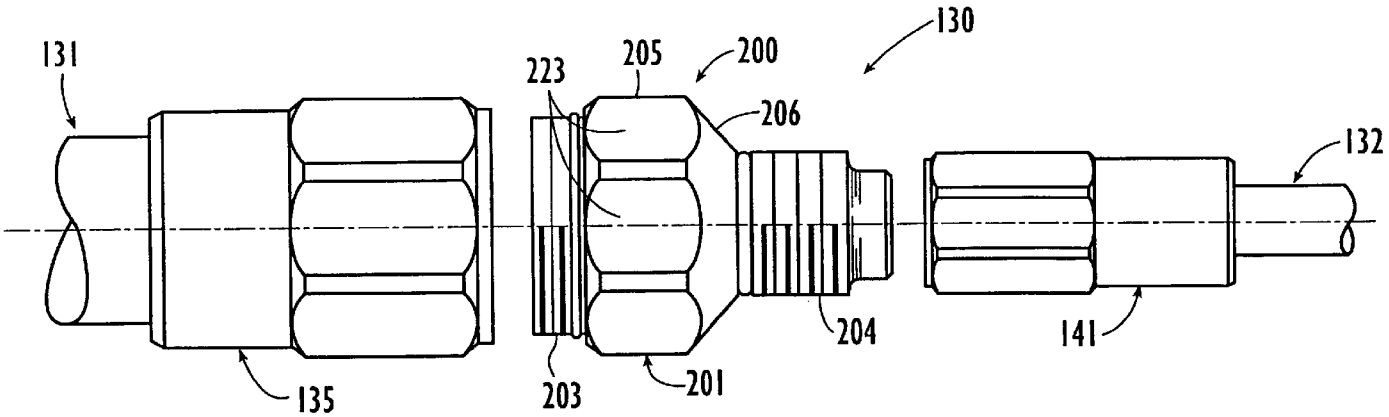
FIG. 4 is an exploded side elevational view of the connector, partially assembled, and as used for joining together a smaller diameter jumper coaxial cable to a larger diameter main coaxial cable in accordance with the present invention.

As shown in the illustrated embodiment, the first and second ends 203, 204 and the first and second intermediate portions 205, 206 of the hollow connector body 201 are preferably integrally formed so that the hollow connector body is a monolithic unit. Accordingly, the connector 130 is relatively straightforward to assemble and is reliable in service. The connector 130 includes only three major portions to assemble as perhaps best shown in FIG. 4. In addition, the connector 130 in accordance with the invention may use conventional back-nut assemblies 135, 141 to thereby facilitate compatibility for replacement of conventional back-to-back connector arrangements 30 as in the prior art (FIGS. 2 and 3).

The connector 130 of the invention may also include the illustrated first and second sealing rings 167, 191 for forming respective first and second seals between the first and second back-nut assemblies 135, 141 and the respective first and second ends 203, 204 of the hollow connector body 201 as will be readily appreciated by those skilled in the art. The resistance to moisture penetration is further enhanced by these 0-rings 167, 191 and because the number of interface locations is reduced by one as compared to the prior art. Of course, the back-nut assemblies 135, 141 may also each include a respective rear 0-ring seal, not shown, for sealing the interface with the cable sheath as will be readily appreciated by those skilled in the art.

Figure 5:
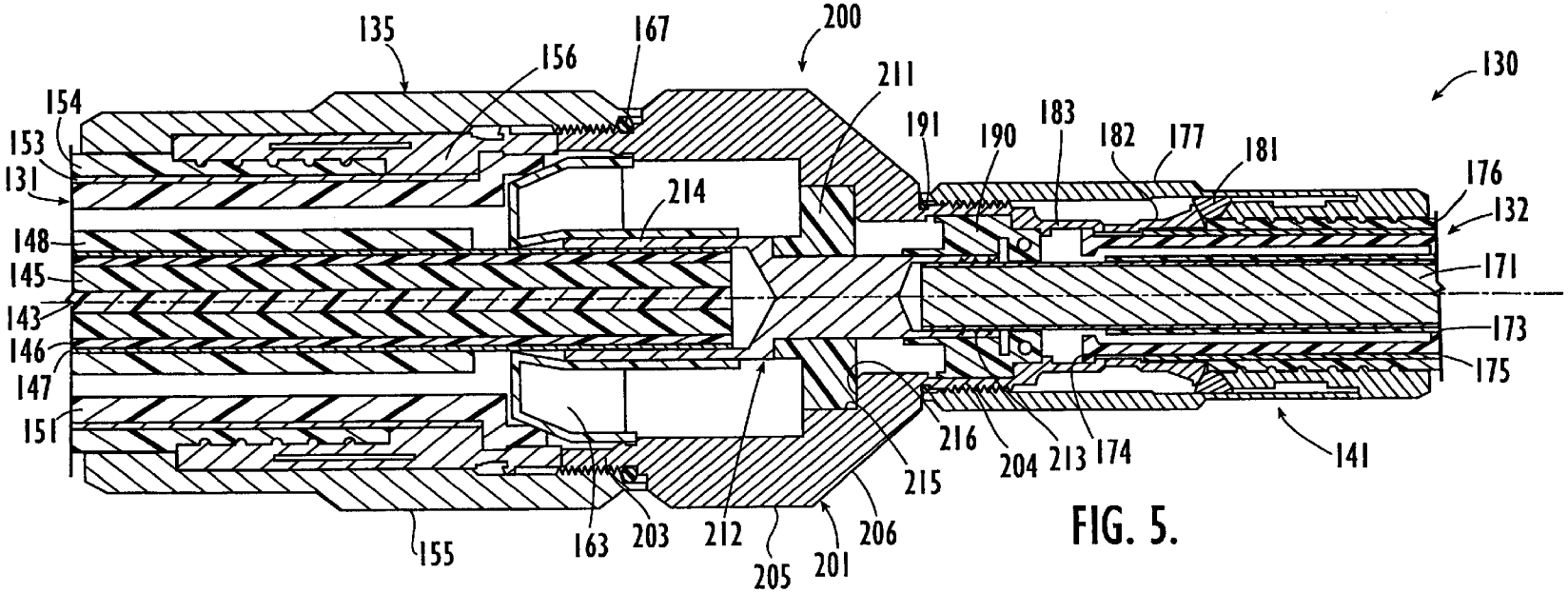
FIG. 5 is a cross-sectional view of the connector as shown in FIG. 4, with the components fully assembled.
Figure 6:
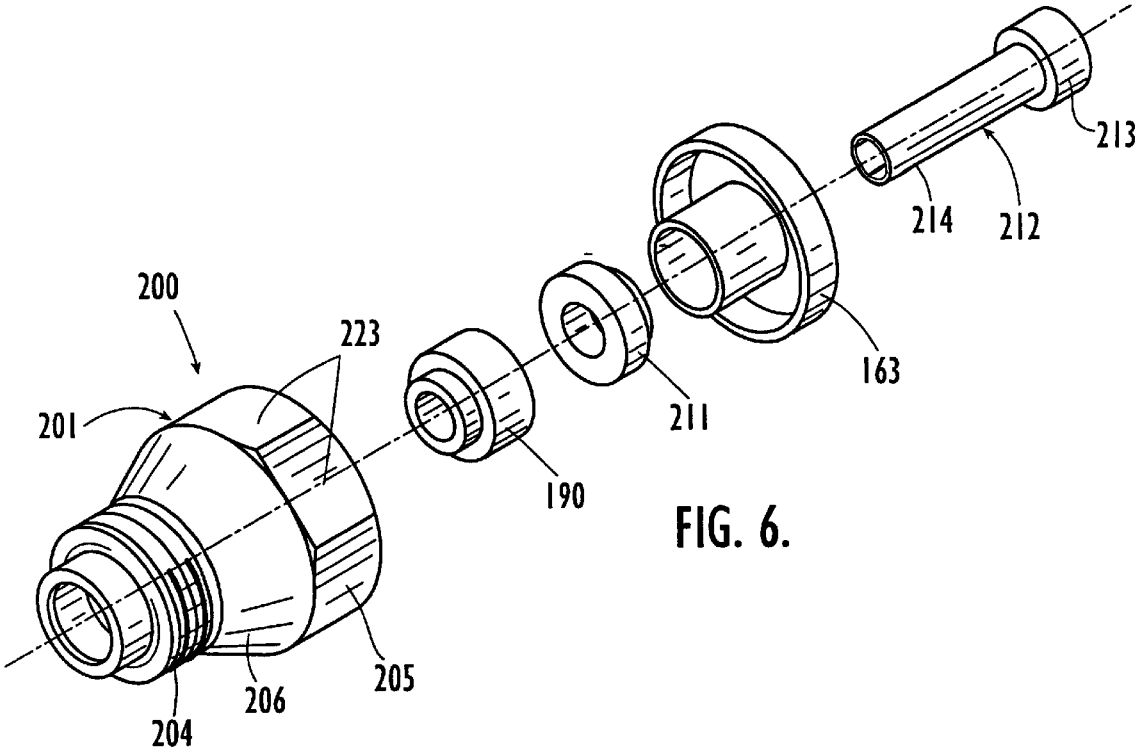
FIG. 6 is an exploded perspective view of a portion of the connector in accordance with the present invention.

As seen perhaps best in the cross-sectional view of FIG. 5, the hollow connector body 201 may include interior portions defining an internal cylindrical passageway 215 with a shoulder 216 adjacent the smaller diameter end 204. In this illustrated embodiment, the dielectric spacer 211 is snugly positioned in the internal cylindrical passageway 215 and abuts the shoulder 216 to ease assembly and provide secure positioning of the spacer 211 and thus proper alignment of the center contact 212.

Figure 7:
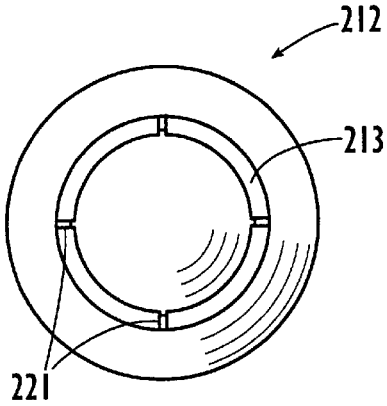
FIGS. 7 and 8 are greatly enlarged end views of opposing ends of the center contact of the connector arrangement as shown in FIG. 6.
Figure 8:
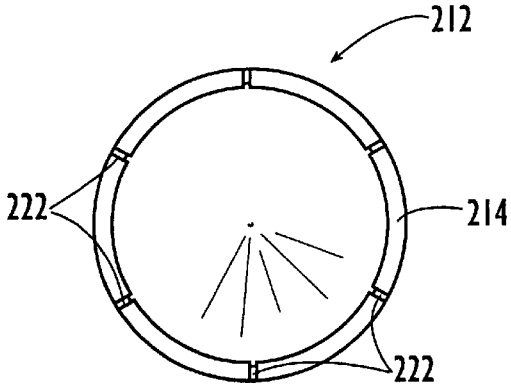

As shown in FIGS. 7 and 8, the first and second ends 213, 214 of the center contact 212 may have a tubular shape for receiving therein the first and second inner conductors 147, 171 respectively. The first and second ends 213, 214 of the center contact 212 may also have respective elongate slots 221, 222 therein. These slots 221, 222 facilitate clamping radially downwardly onto the respective center conductors 147, 171 as will now be further explained.

The connector 130 also includes first and second dielectric clamping members 163, 190 for clamping the first and second tubular ends 213, 214 of the center contact 212 onto the respective inner conductors 147, 171 of the first and second coaxial cables 131, 132. This clamping occurs responsive to progressive tightening of the threaded engagement between the first and second ends 203, 204 of the hollow connector body 201 and the respective first and second back-nut assemblies 135, 141 as will be readily appreciated by those skilled in the art.

The first intermediate portion of the hollow connector body may have a series of flats 223 (FIGS. 4 and 6) on a periphery thereof. These flats 223 facilitate gripping during assembly. In another embodiment, the gripping portions may be provided in the form of spanner holes around the periphery as will be readily appreciated by those skilled in the art. The hollow connector body 201 may comprise brass with a silver plating thereon; however, those of skill in the art will recognize that other electrically conductive and corrosion resistant materials may be used as well. In addition, the hollow connector body 201 may include a surface treatment rather than a plating, for example.

Another advantageous feature of the present invention is at least that the outer conductor 147 of the first coaxial cable 131 may be a smooth wall conductor. In this embodiment, the outer conductor clamping portions of the first back-nut assembly 135 are configured to engage the smooth wall conductor of the first coaxial cable. Both cables 131, 132 may have a smooth wall outer conductor, and the outer conductor clamping portions of the second back-nut assembly 141 may also be configured to cooperate with the smooth wall cable. The smooth wall outer conductor is generally stronger under tensile forces than a corrugated conductor, for example.

In other embodiments, one or both of the cables 131, 132 may have a corrugated outer conductor as will be readily appreciated by those skilled in the art. As will also be understood by those skilled in the art, the respective outer conductor clamping portions of the back-nut assemblies may be configured to cooperate with the corrugated outer conductors without requiring further discussion herein. For typical corrugated outer conductor back-nut assemblies, the threaded distal ends are typically external rather than internal as described above. Accordingly, in such an embodiment, the hollow connector body would include internally threaded first and second ends as will be readily understood by those skilled in the art.

A method aspect of the invention is for joining together a first coaxial cable 131 having a first diameter and a second coaxial cable 132 having a second diameter smaller than the first diameter. Each coaxial cable preferably has an inner conductor, a dielectric region surrounding the inner conductor and an outer conductor surrounding the dielectric region. The method preferably comprises the steps of: attaching a first back-nut assembly 135 on the first coaxial cable 131, the first back-nut assembly comprising a threaded distal end, and outer conductor clamping portions for coupling to the outer conductor of the first coaxial cable; and attaching a second back-nut assembly 141 on the second coaxial cable 132, the second back-nut assembly comprising a threaded distal end, and outer conductor clamping portions for coupling to the outer conductor of the second coaxial cable.

More particularly, the method also preferably includes the step of attaching the first and second back-nut assemblies 135, 141 together using a hollow connector body 201 comprising opposing first and second threaded ends to be threadingly engaged in the respective threaded distal ends of the first and second back-nut assemblies, and an intermediate portion 206 having a frusto-conical shape with a larger diameter portion adjacent the first end and a smaller diameter portion adjacent the second end. A dielectric spacer 211 is preferably positioned within a medial portion of the hollow conductive body 201 and has an opening extending therethrough. An elongate center contact 212 is preferably positioned within the opening of the dielectric spacer 211 and has opposing ends coupling to the respective inner conductors of the first and second coaxial cables. The first and second ends and the intermediate portion of the hollow connector body 201 are preferably integrally formed so that the hollow connector body is a monolithic unit.

One preferred assembly sequence for the first and second back-nut assemblies 135, 141 and hollow connector body 201 may include securing the first back-nut assembly onto the first cable, securing the hollow connector body 201 to the first back-nut assembly, positioning the second back-nut assembly on the second cable, and tightening the second back-nut assembly onto the hollow connector body. Of course other assembly sequences are also contemplated by the invention as will be appreciated by those skilled in the art.

The method may also preferably include the step of positioning first and second sealing rings 167, 191 for forming respective first and second seals between the first and second back-nut assemblies 135, 141 and the hollow connector body 201. Each of the ends of the first and second back-nut assemblies is may be internally threaded, and each of the first and second threaded ends of the hollow connector body 201 may be externally threaded.

The first and second ends of the center 212 contact may have a tubular shape for receiving therein the first and second inner conductors respectively. The first and second ends of the center contact 212 may also have elongate slots therein. Accordingly, the method may further comprise the step of positioning first and second dielectric clamping members 163, 190 for clamping the first and second tubular ends of the center contact 212 onto the respective inner conductors of the first and second coaxial cables 131, 132 responsive to progressive tightening of the threaded engagement between the first and second ends of the monolithic hollow connector body 201 and the respective first and second back-nut assemblies.

The hollow connector body 201 preferably further comprises a cylindrical intermediate portion 205 between the intermediate portion 206 having a frusto-conical shape and the first end. The cylindrical intermediate portion 205 of the hollow connector body 201 also preferably has a series of gripping portions, such as flats 223, on a periphery thereof. Accordingly, the method also preferably includes the step of gripping the cylindrical intermediate portion 205 using the gripping portions thereon.

The first back-nut assembly 135 may have a corresponding size to receive the first cable 131 having a diameter within a range of about 1 to 3 inches. The second back-nut assembly 141 may have a corresponding size to receive the second cable 132 having a diameter within a range of about ¼ inch to 1 and ¼ inches in diameter. In addition, at least the outer conductor of the first coaxial cable may be a smooth wall conductor, and the outer conductor clamping portions of the first back-nut assembly may be configured to engage the smooth wall conductor of the first coaxial cable. Of course, one or both of the cables may also have a corrugated outer conductor.

The connector 130 of the invention provides a number of significant advantages over the conventional back-to-back connector arrangement 30 of the prior art. For example, the connector 130 of the invention when used for a coaxial cable route for a wireless base station 20 as shown in FIG. 1 eliminates two connections, that is, it replaces six connections with four connections. The connector 130 provides a secure weather seal and eliminates the conventional N interface. The connector 130 has improved mechanical robustness, less interfaces to cause problems, and makes secondary weatherproofing easier. The connector 130 has reduced insertion loss versus conventional back-to-back connector arrangements 30. The connector 130 can also be mixed and matched with conventional connector parts, such as the back-nut assemblies. In addition, the connector 130 is less expensive than conventional connector arrangements. The frusto-conical shape of the second intermediate portion 206 facilitates passage through openings or adjacent edges, such as may be found in a wireless base station system 20 (FIG. 1). In other words, the connector 130 of the invention presents a clean, streamlined outer shape in contrast to the prior art back-to-back connector arrangement 30.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A coaxial cable connector for joining together a first coaxial cable having a first diameter and a second coaxial cable having a second diameter smaller than the first diameter, each coaxial cable having an inner conductor, a dielectric region surrounding the inner conductor and an outer conductor surrounding the dielectric region, the coaxial cable connector comprising:

a first back-nut assembly comprising a distal threaded end, and outer conductor clamping portions for coupling to the outer conductor of the first coaxial cable;

a second back-nut assembly comprising a distal threaded end, and outer conductor clamping portions for coupling to the outer conductor of the second coaxial cable;

a hollow connector body for joining said first and second back-nut assemblies together and comprising opposing first and second threaded ends to be threadingly engaged with the respective distal threaded ends of the first and second back-nut assemblies, and an intermediate portion having a frusto-conical shape with a larger diameter portion adjacent the first threaded end and a smaller diameter portion adjacent the second threaded end, a dielectric spacer positioned within a medial portion of said hollow conductive body and having an opening extending therethrough; and a center contact positioned within the opening of said dielectric spacer and having opposing ends for coupling to the respective inner conductors of the first and second coaxial cables.

2. A coaxial cable connector according to claim 1 wherein said first and second threaded ends, and said intermediate portion of said hollow connector body are all integrally formed so that said hollow connector body is a monolithic unit.

3. A coaxial cable connector according to claim 1 further comprising first and second sealing rings for forming respective first and second seals between said first and second back-nut assemblies and said hollow connector body.

4. A coaxial cable connector according to claim 1 wherein each of said distal threaded ends of the first and second back-nut assemblies is internally threaded; and wherein each of said first and second threaded ends of said hollow connector body is externally threaded.

5. A coaxial cable connector according to claim 1 wherein said hollow connector body comprises portions defining an internal cylindrical passageway with a shoulder adjacent the smaller diameter end; and wherein said dielectric spacer is positioned in said internal cylindrical passageway and abutting said shoulder.

6. A coaxial cable connector according to claim 5 wherein said dielectric spacer has an annular shape.

7. A coaxial cable connector according to claim 1 wherein the opposing ends of said center contact have a tubular shape for receiving therein the first and second inner conductors respectively.

8. A coaxial cable connector according to claim 7 wherein the opposing ends of said center contact have elongate slots therein; and further comprising first and second dielectric clamping members for clamping the opposing ends of said center contact onto the respective inner conductors of the first and second coaxial cables responsive to progressive tightening of the threaded engagement between the first and second threaded ends of the hollow connector body and the respective distal threaded ends of the first and second back-nut assemblies.

9. A coaxial cable connector according to claim 1 further comprising a cylindrical intermediate portion having a series of gripping portions on a periphery thereof between said intermediate portion having a frusto-conical shape and said first threaded end.

10. A coaxial cable connector according to claim 1 wherein said hollow connector body comprises brass with a silver plating thereon.

11. A coaxial cable connector according to claim 1 wherein the first back-nut assembly has a corresponding size to receive the first cable having a diameter within a range of about 1 to 3 inches; and wherein the second back-nut assembly has a corresponding size to receive the second cable having a diameter within a range of about ¼ inch to 1 and ¼ inches in diameter.

12. A coaxial cable connector according to claim 1 wherein at least the outer conductor of the first coaxial cable is a smooth wall conductor; and wherein said outer conductor clamping portions of said first back-nut assembly are configured to engage the smooth wall conductor of the first coaxial cable.

13. A coaxial cable connector for joining together a first coaxial cable having a first diameter and a second coaxial cable having a second diameter smaller than the first diameter, each coaxial cable having an inner conductor, a dielectric region surrounding the inner conductor and an outer conductor surrounding the dielectric region, the coaxial cable connector comprising:

a first back-nut assembly comprising a distal threaded end, and outer conductor clamping portions for coupling to the outer conductor of the first coaxial cable;

a second back-nut assembly comprising a distal threaded end, and outer conductor clamping portions for coupling to the outer conductor of the second coaxial cable;

a monolithic hollow connector body for joining said first and second back-nut assemblies together and comprising opposing first and second threaded ends to be threadingly engaged in respective threaded distal ends of the first and second back-nut assemblies, an intermediate portion having a frusto-conical shape with a larger diameter portion adjacent the first threaded end and a smaller diameter portion adjacent the second threaded end, an annular dielectric spacer positioned within a medial portion of said monolithic hollow conductive body and having an opening extending therethrough; and an elongate center contact positioned within the opening of said annular dielectric spacer and having opposing ends for coupling to the respective inner conductors of the first and second coaxial cables.

14. A coaxial cable connector according to claim 13 further comprising first and second sealing rings for forming respective first and second seals between said first and second back-nut assemblies and said monolithic hollow connector body.

15. A coaxial cable connector according to claim 13 wherein each of said distal threaded ends of the first and second back-nut assemblies is internally threaded; and wherein each of said first and second threaded ends of said monolithic hollow connector body is externally threaded.

16. A coaxial cable connector according to claim 13 wherein said monolithic hollow connector body comprises portions defining an internal cylindrical passageway with a shoulder adjacent the smaller diameter end; and wherein said dielectric spacer is positioned in said internal cylindrical passageway and abutting said shoulder.

17. A coaxial cable connector according to claim 13 wherein the opposing ends of said center contact have a tubular shape for receiving therein the first and second inner conductors respectively.

18. A coaxial cable connector according to claim 17 wherein the opposing ends of said center contact have elongate slots therein; and further comprising first and second dielectric clamping members for clamping the opposing ends of said center contact onto the respective inner conductors of the first and second coaxial cables responsive to progressive tightening of the threaded engagement between the first and second ends of the monolithic hollow connector body and the respective threaded distal ends of the first and second back-nut assemblies.

19. A coaxial cable connector according to claim 13 further comprising a cylindrical intermediate portion having a series of gripping portions on a periphery thereof between said intermediate portion having a frusto-conical shape and said first threaded end.

20. A coaxial cable connector according to claim 13 wherein said hollow connector body comprises brass with a silver plating thereon.

21. A coaxial cable connector according to claim 13 wherein the first back-nut assembly has a corresponding size to receive the first cable having a diameter within a range of about 1 to 3 inches; and wherein the second back-nut assembly has a corresponding size to receive the second cable having a diameter within a range of about ¼ inch to 1 and ¼ inches in diameter.

22. A coaxial cable connector according to claim 13 wherein at least the outer conductor of the first coaxial cable is a smooth wall conductor; and wherein said outer conductor clamping portions of said first back-nut assembly are configured to engage the smooth wall conductor of the first coaxial cable.

23. A wireless base station system comprising:

an antenna tower and an antenna mounted thereon;

a radio adjacent said antenna tower; and a coaxial cable system extending between said radio and said antenna, said coaxial cable system comprising a first coaxial cable, at least one second coaxial cable, and at least one connector for joining together the first coaxial cable to the at least one second coaxial cable, the first coaxial cable having a first diameter and the at least one second coaxial cable having a second diameter smaller than the first diameter, each coaxial cable having an inner conductor, a dielectric region surrounding the inner conductor and an outer conductor surrounding the dielectric region, the coaxial cable connector comprising a first back-nut assembly comprising a distal threaded end, and outer conductor clamping portions for coupling to the outer conductor of the first coaxial cable, a second back-nut assembly comprising a distal threaded end, and outer conductor clamping portions for coupling to the outer conductor of the second coaxial cable, a hollow connector body for joining said first and second back-nut assemblies together and comprising opposing first and second threaded ends to be threadingly engaged with respective distal threaded ends of the first and second back-nut assemblies, and an intermediate portion having a frusto-conical shape with a larger diameter portion adjacent the first threaded end and a smaller diameter portion adjacent the second threaded end, a dielectric spacer positioned within a medial portion of said hollow conductive body and having an opening extending therethrough, and a center contact positioned within the opening of said dielectric spacer and having opposing ends for coupling to the respective inner conductors of the first and second coaxial cables.

24. A wireless base station according to claim 23 wherein said first and second threaded ends, and said intermediate portion of said hollow connector body are all integrally formed so that said hollow connector body is a monolithic unit.

25. A wireless base station according to claim 23 further comprising first and second sealing rings for forming respective first and second seals between said first and second back-nut assemblies and said hollow connector body.

26. A wireless base station according to claim 23 wherein said hollow connector body comprises portions defining an internal cylindrical passageway with a shoulder adjacent the smaller diameter end; and wherein said dielectric spacer is positioned in said internal cylindrical passageway and abutting said shoulder.

27. A wireless base station according to claim 26 wherein said dielectric spacer has an annular shape.

28. A wireless base station according to claim 23 wherein the opposing ends of said center contact have a tubular shape for receiving therein the first and second inner conductors respectively.

29. A wireless base station according to claim 28 wherein the opposing ends of said center contact have elongate slots therein; and further comprising first and second dielectric clamping members for clamping the opposing ends of said center contact onto the respective inner conductors of the first and second coaxial cables responsive to progressive tightening of the threaded engagement between the first and second threaded ends of the hollow connector body and the respective threaded distal ends of the first and second back-nut assemblies.

30. A wireless base station according to claim 23 further comprising a cylindrical intermediate portion having a series of gripping portions on a periphery thereof between said intermediate portion having a frusto-conical shape and said first threaded end.

31. A method for joining together a first coaxial cable having a first diameter and a second coaxial cable having a second diameter smaller than the first diameter, each coaxial cable having an inner conductor, a dielectric region surrounding the inner conductor and an outer conductor surrounding the dielectric region, the method comprising the steps of:

attaching a first back-nut assembly on the first coaxial cable, the first back-nut assembly comprising a threaded distal end, and outer conductor clamping portions for coupling to the outer conductor of the first coaxial cable;

attaching a second back-nut assembly on the second coaxial cable, the second back-nut assembly comprising a threaded distal end, and outer conductor clamping portions for coupling to the outer conductor of the second coaxial cable; and attaching the first and second back-nut assemblies together using a hollow connector body comprising opposing first and second threaded ends to be threadingly engaged in respective threaded distal ends of the first and second back-nut assemblies, an intermediate portion having a frusto-conical shape with a larger diameter portion adjacent the first threaded end and a smaller diameter portion adjacent the second threaded end, a dielectric spacer positioned within a medial portion of the hollow conductive body and having an opening extending therethrough, and a center contact positioned within the opening of the dielectric spacer and having opposing ends coupling to the respective inner conductors of the first and second coaxial cables.

32. A method according to claim 31 wherein the first and second ends and the intermediate portion of the hollow connector body are integrally formed so that the hollow connector body is a monolithic unit.

33. A method according to claim 31 further comprising the step of positioning first and second sealing rings for forming respective first and second seals between the first and second back-nut assemblies and the hollow connector body.

34. A method according to claim 31 wherein each of the distal threaded ends of the first and second back-nut assemblies is internally threaded; and wherein each of the first and second threaded ends of the hollow connector body is externally threaded.

35. A method according to claim 31 wherein the opposing ends of the center contact have a tubular shape for receiving therein the first and second inner conductors respectively; wherein the opposing ends of the center contact have elongate slots therein; and further comprising the step of positioning first and second dielectric clamping members for clamping the opposing ends of the center contact onto the respective inner conductors of the first and second coaxial cables responsive to progressive tightening of the threaded engagement between the first and second threaded ends of the hollow connector body and the respective threaded distal ends of the first and second back-nut assemblies.

36. A method according to claim 31 wherein the hollow connector body further comprises a cylindrical intermediate portion having a series of gripping portions on a periphery thereof; between the intermediate portion having a frusto-conical shape and the first end and further comprising the step of gripping the cylindrical intermediate portion using the gripping portions thereon.

37. A method according to claim 31 wherein the first back-nut assembly has a corresponding size to receive the first cable having a diameter within a range of about 1 to 3 inches; and wherein the second back-nut assembly has a corresponding size to receive the second cable having a diameter within a range of about ¼ inch to 1 and ¼ inches in diameter.

38. A method according to claim 31 wherein at least the outer conductor of the first coaxial cable is a smooth wall conductor; and wherein the outer conductor clamping portions of the first back-nut assembly are configured to engage the smooth wall conductor of the first coaxial cable.

* * * * *

UNITED STATES PATENT AND TRADEMARK OFFICE

CERTIFICATE OF CORRECTION

PATENT NO. : 6,217,380 B1
DATED : April 17, 2001
INVENTOR(S) : Larry W. Nelson, Ronald A. Vaccaro It is certified that error appears in the above-identified patent and that said Letters Patent is hereby corrected as shown below:

Drawings,
Delete "FIG. 2" insert -- new FIG. 2 --

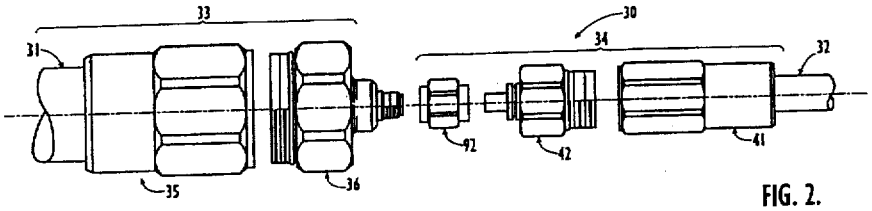

FIG. 2.
(PRIOR ART)

Column 3,
Line 28, delete "assembly" insert -- assemble --
Line 52, delete "AND" insert -- and --

Column 6,
Line 61, delete "crespective" insert -- respective --

Column 9,
Line 14, delete "assemblies is may" insert -- assemblies may --

Column 10,
Line 33, delete "with the respective" insert -- with respective --

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*